US007213284B2

(12) United States Patent
Huang et al.

(10) Patent No.: US 7,213,284 B2
(45) Date of Patent: May 8, 2007

(54) OPTIC DISK PACK OPENER

(76) Inventors: Te-Ming Huang, 5F-11, No.16, Lane 609, Sec. 5, Chung-Hsin Rd., San Chung City, Taipei Hsien (TW); Jason Chen, 107 Hearth Stone La., Marlton, NJ (US) 08053

( * ) Notice: Subject to any disclaimer, the term of this patent is extended or adjusted under 35 U.S.C. 154(b) by 225 days.

(21) Appl. No.: 11/121,255

(22) Filed: May 3, 2005

(65) Prior Publication Data

US 2006/0248725 A1 Nov. 9, 2006

(51) Int. Cl.
*B26B 11/00* (2006.01)
*B67B 7/48* (2006.01)
*B26B 29/02* (2006.01)

(52) U.S. Cl. ..... 7/160; 30/2; 30/289

(58) Field of Classification Search ..... 7/160; 30/2, 286, 289, 293, 294
See application file for complete search history.

(56) References Cited

U.S. PATENT DOCUMENTS 5,522,135 A * 6/1996 Votolato ..... 30/2
5,555,624 A * 9/1996 McCracken ..... 30/2
6,615,495 B1 * 9/2003 Evens et al. ..... 30/289
7,024,772 B1 * 4/2006 Shaver et al. ..... 30/2
2006/0053637 A1 * 3/2006 Neiser ..... 30/286
2006/0090347 A1 * 5/2006 Lin ..... 30/162
2006/0143922 A1 * 7/2006 Chou ..... 30/2

* cited by examiner

*Primary Examiner*—David B. Thomas

(57) ABSTRACT

An optic disk opener includes an elongate stem having an end defining an interior space receiving a spring-biased sharp member that is extendible out of the space by being manually driven, against the biasing force, to physically engaging an optic disk pack that is wrapped with a plastic film, whereby when the opener is moved along an edge of the optic disk pack, the sharp blade breaks the film. Two spaced flanges are formed on the first end to receive the edge of the optic disk pack and guide the movement of the opener. An elongate member is pivoted to the first end and movable between an operation position where a soft layer attached to a surface of the elongate member is exposed to wipe and clean an optic disk and a stowed position where the elongate member overlaps the stem to shield the soft layer.

20 Claims, 6 Drawing Sheets

OPTIC DISK PACK OPENER

BACKGROUND OF THE INVENTION

1. Field of the Invention

The present invention relates generally to a device for facilitating removal of a plastic wrapping film out of an optic disk pack, and in particular to a combination of an optic disk pack opener with a writing implement to facilitate operation effectiveness of the optic disk pack opener.

2. The Prior Arts

Optic disks, such as compact disks and video compact disks, are commonly stored in a rigid plastic case that has a small thickness as compared to length and width thereof. The optic disk case is wrapped with a plastic film for protection and burglary-proof purposes. The plastic film must be removed before the general consumers may access the disk contained in the plastic case. Often a sharp article, such as a knife or a sharp-ended pin, must be used to break and thus remove the film. This is to some extents troublesome to the general users.

The present invention is aimed to provide an optic disk pack opener that breaks and thus helps removing the plastic film from the optic disk pack.

SUMMARY OF THE INVENTION

Thus, an objective of the present invention is to provide an optic disk pack opener that comprises guide flanges to guide the movement of a sharp blade along an edge of the optic disk pack to break the plastic wrapping film of the optic disk pack thereby helping removing the film out of the pack.

Another objective of the present invention is to provide an optic disk opener in combination with a writing implement to facilitate the effectiveness of the optic disk pack opener.

A further objective of the present invention is to provide an optic disk pack opener in combination with an optic disk surface cleaning member, which wipes and cleans the surfaces of an optic disk.

In accordance with the present invention, to realize the above objectives, an optic disk pack opener is provided, comprising an elongate stem having an end defining an interior space receiving a spring-biased sharp member that is extendible out of the space by being manually driven, against the biasing force, to physically engaging an optic disk pack that is wrapped with a plastic film, whereby when the opener is moved along an edge of the optic disk pack, the sharp blade breaks the film. Two spaced flanges are formed on the first end to receive the edge of the optic disk pack and guide the movement of the opener. An elongate member is pivoted to the first end and movable between an operation position where a soft layer attached to a surface of the elongate member is exposed to wipe and clean an optic disk and a stowed position where the elongate member overlaps the stem to shield the soft layer. The stem has an opposite end that forms a writing implement, which may be selectively capped.

The present invention will become more obvious from the following description when taken in connection with the accompanying drawings, which show, for purposes of illustration only, a preferred embodiment in accordance with the present invention. In the drawings:

DETAILED DESCRIPTION OF THE PREFERRED EMBODIMENT

Figure 1:
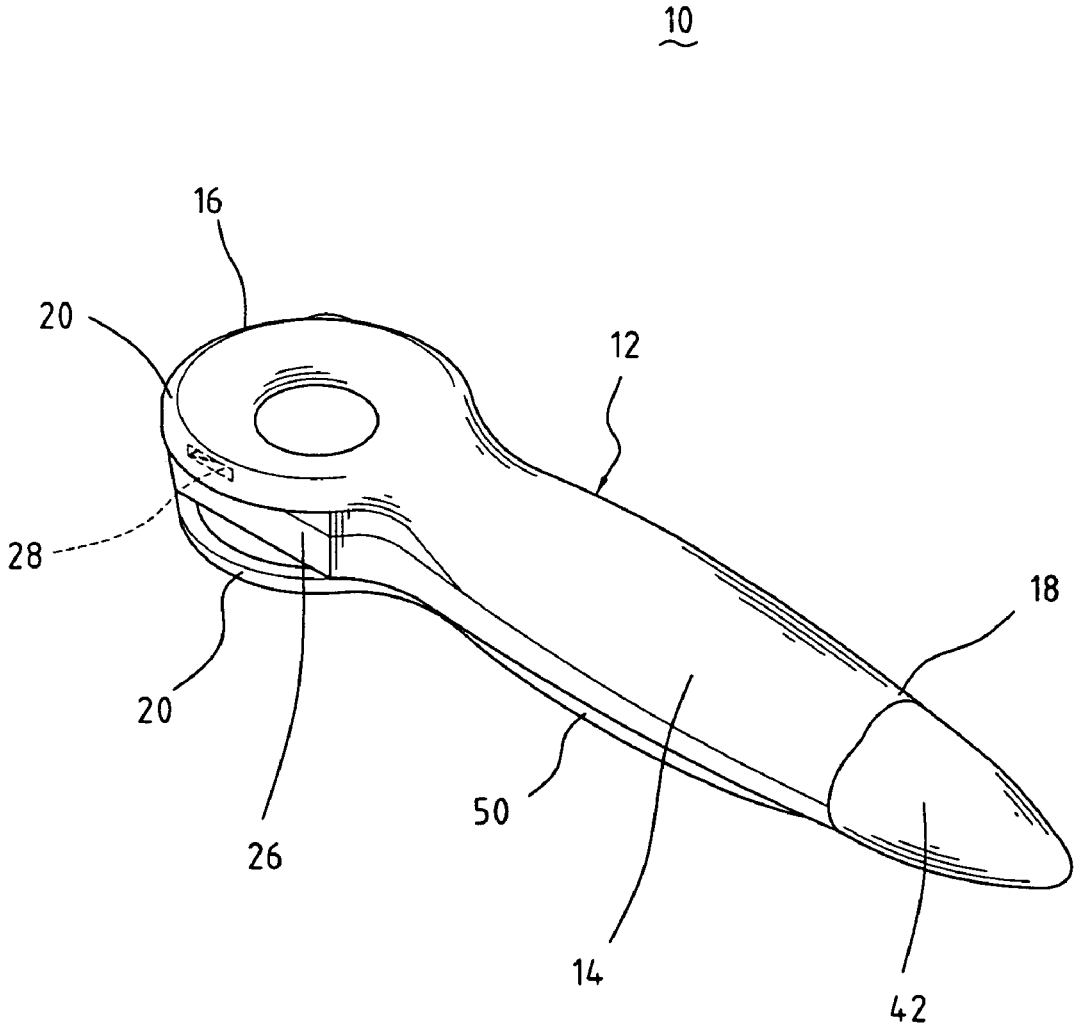
FIG. 1 is a perspective view of an optic disk pack opener constructed in accordance with the present invention in a closed condition.

With reference to the drawings, and in particular to FIG. 1, an optic disk pack opener constructed in accordance with the present invention, generally designated with reference numeral 10, comprises a body 12 forming an elongate stem 14 for hand holding by a user. The elongate stem 14 has a first end 16 and an opposite second end 18.

Figure 5:
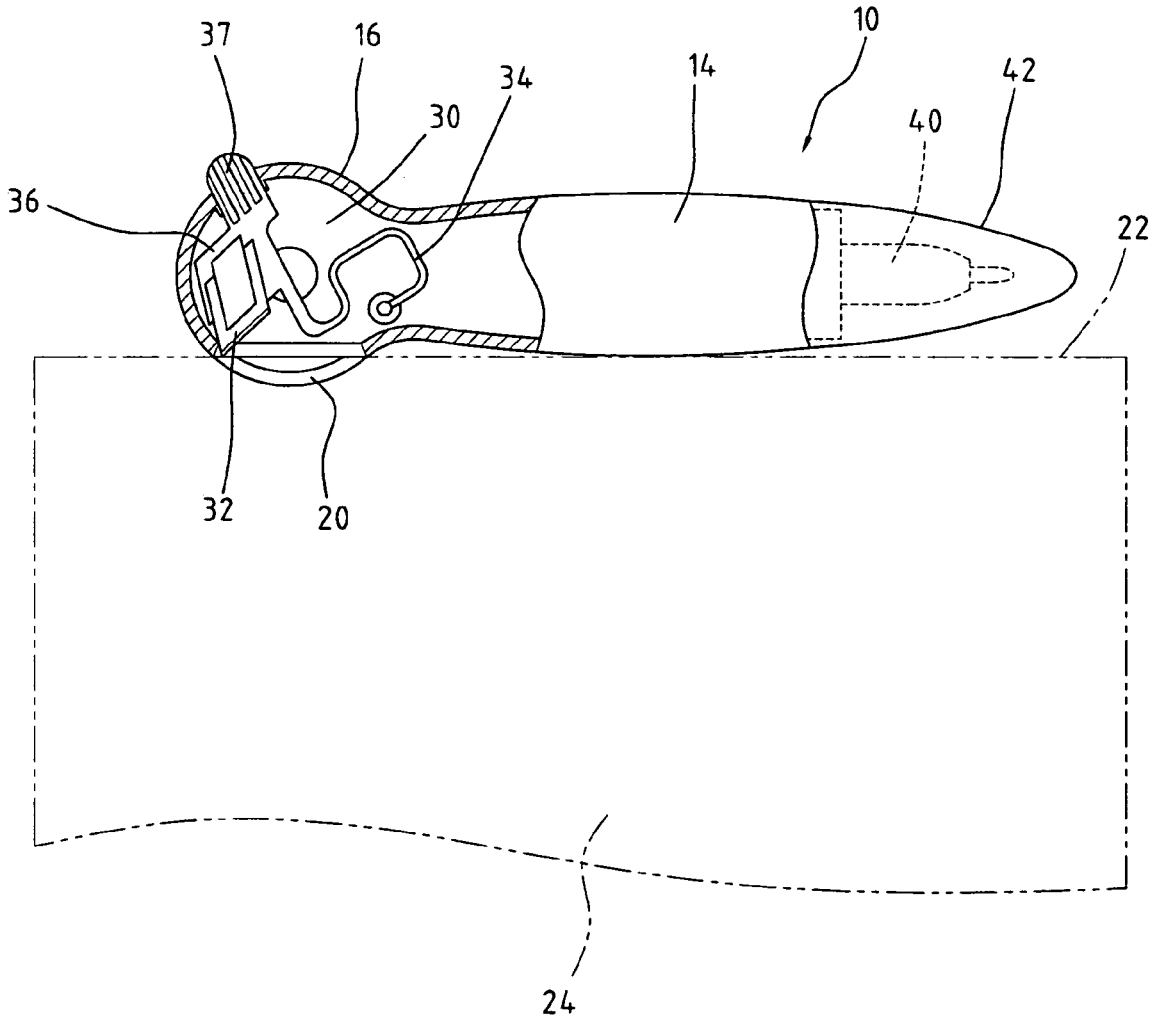
FIG. 5 is a plan view of the optic disk pack opener of the present invention, partially cross-sectioned to illustrate inside details of the opener, together with an optic disk pack shown in phantom lines.
Figure 6:
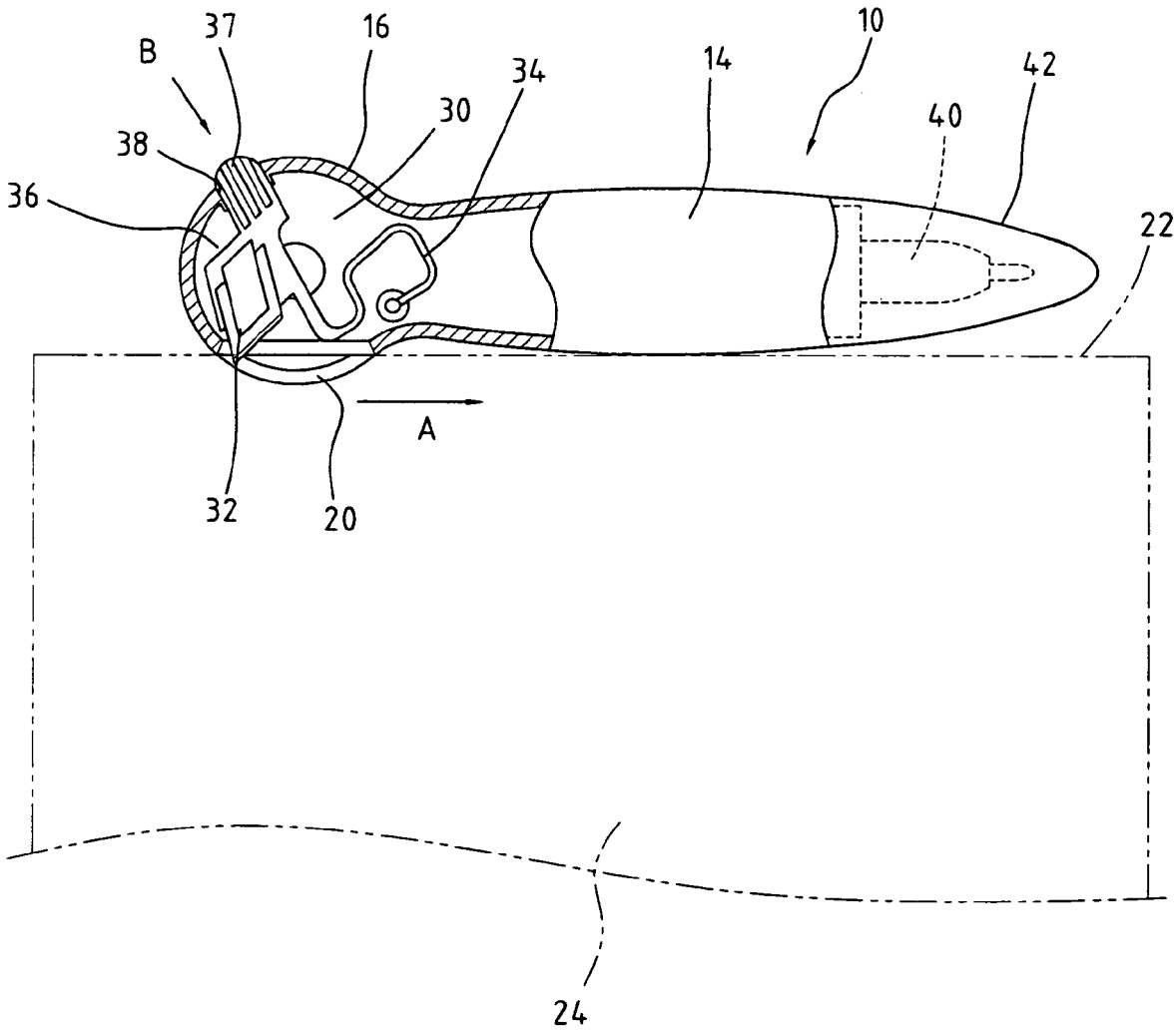
FIG. 6 is similar to FIG. 5, showing the operation of the opener of the present invention in breaking a packing film of the optic disk pack.

Also referring to FIGS. 5 and 6, the first end 16 of the stem 14 has two spaced flanges 20 substantially parallel to each other and defining therebetween a slot (not labeled) having a width substantially corresponding to the thickness of an edge 22 of an optic disk pack 24 whereby the edge 22 of the pack 24 can be snugly received in the slot and interposed between the flanges 20 with a small clearance between the flanges 20 and the pack 22, which clearance allows the opener 10 to slide along the edge 22 of the pack 24 under the guidance of the flanges 20, as indicated by arrow A of FIG. 6.

Preferably, the slot has a flat bottom 26 to slide along the edge 22 of the pack 24. An opening 28, also see FIG. 3, preferably in the form of an elongate slot parallel to the sliding direction of the opener 10 with respect to the optic disk pack 24, is defined in the bottom 26. The first end 16 of the stem 14 defines an interior space 30 in communication with the opening 28. A sharp blade 32 is received in the interior space 30 and is biased by a resilient member 34 to be completely accommodated in the interior space 30 for safety purposes. The resilient member 34 can be made of any suitable material and in any proper form provided a force biasing the sharp blade 32 within the interior space 30 is induced on the sharp blade 32. In a preferred embodiment, the resilient member 34 is a U-shaped or multi-folded leaf spring made of plastic injection molding. The leaf spring comprises a mounting portion 36 to support the sharp blade 32.

A button 37 is integrally formed with or mounted to the mounting portion 36 and extending beyond the first end 16 of the stem 14 through another opening 18 defined in the first end 16 of the stem 14 and in communication with the interior space 30. The button 37 is arranged to be accessible to and depressed by a user, as indicated by arrow B of FIG. 6, to counteract the spring force of the resilient member 34 thereby extending the sharp blade 32 out of the opening 28 to physically engage the packing film of the optic disk pack 24 received between the flanges 20. The engagement between the sharp blade 32 and the packing film of the optic disk pack 24 allows the sharp blade 32 to break and thus help removing the film out of the optic disk pack 24.

Figure 2:
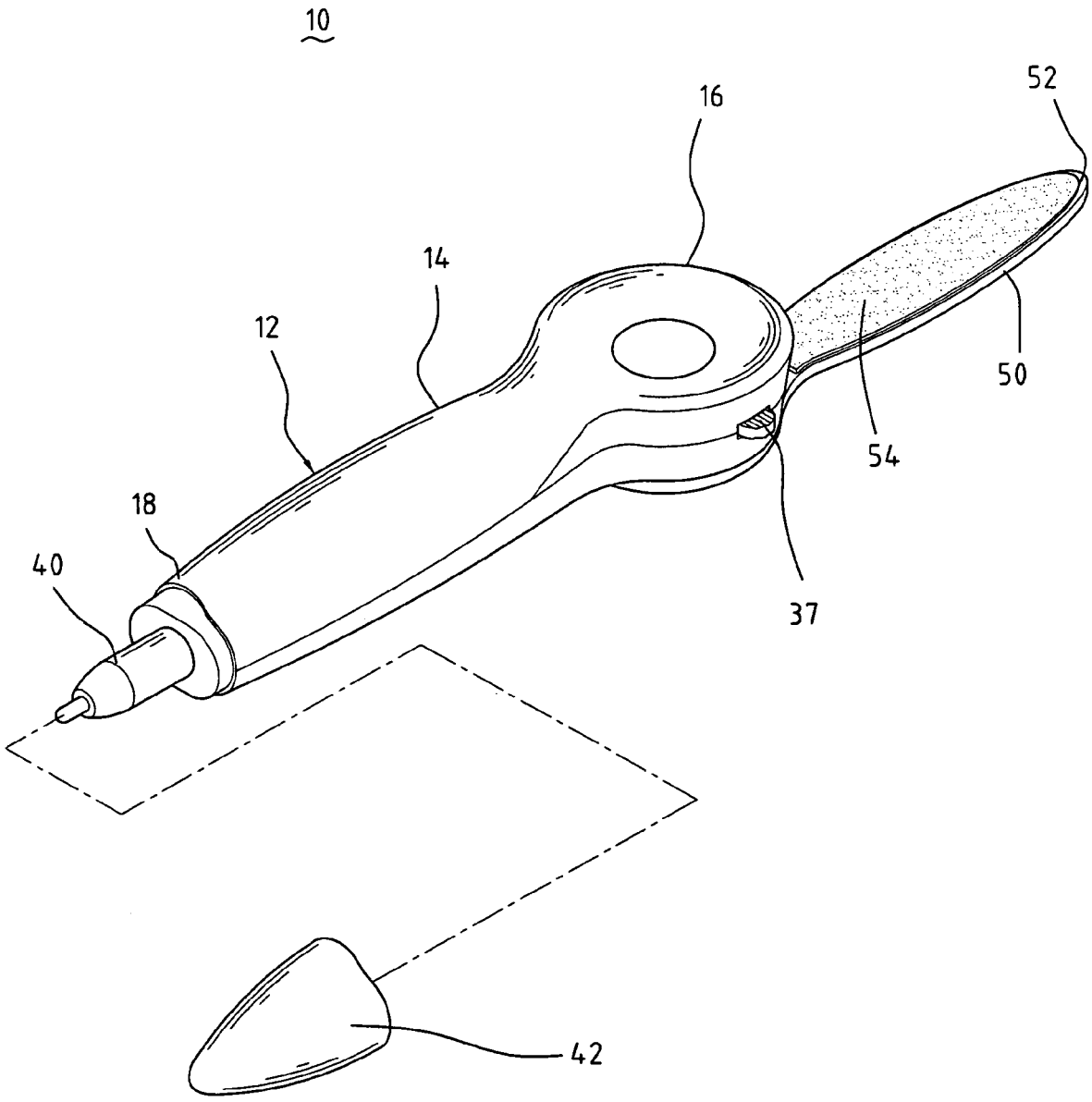
FIG. 2 is a perspective view of the optic disk pack opener in such an operation condition that a cap is removed to expose a writing implement and an optic disk surface cleaning member is extended for cleaning the surface of an optic disk.

Also referring to FIG. 2, the second end 18 is provided with a writing implement 40, whereby the stem 14 also serves as a holding barrel for the writing implement 40. Preferably, a cap 42 is selectively attachable to the second end 18 of the stem 14 to shield and protect the writing implement 40. This arrangement allows the opener 10 to also serve as a pen when not used to open an optic disk pack.

Figure 3:
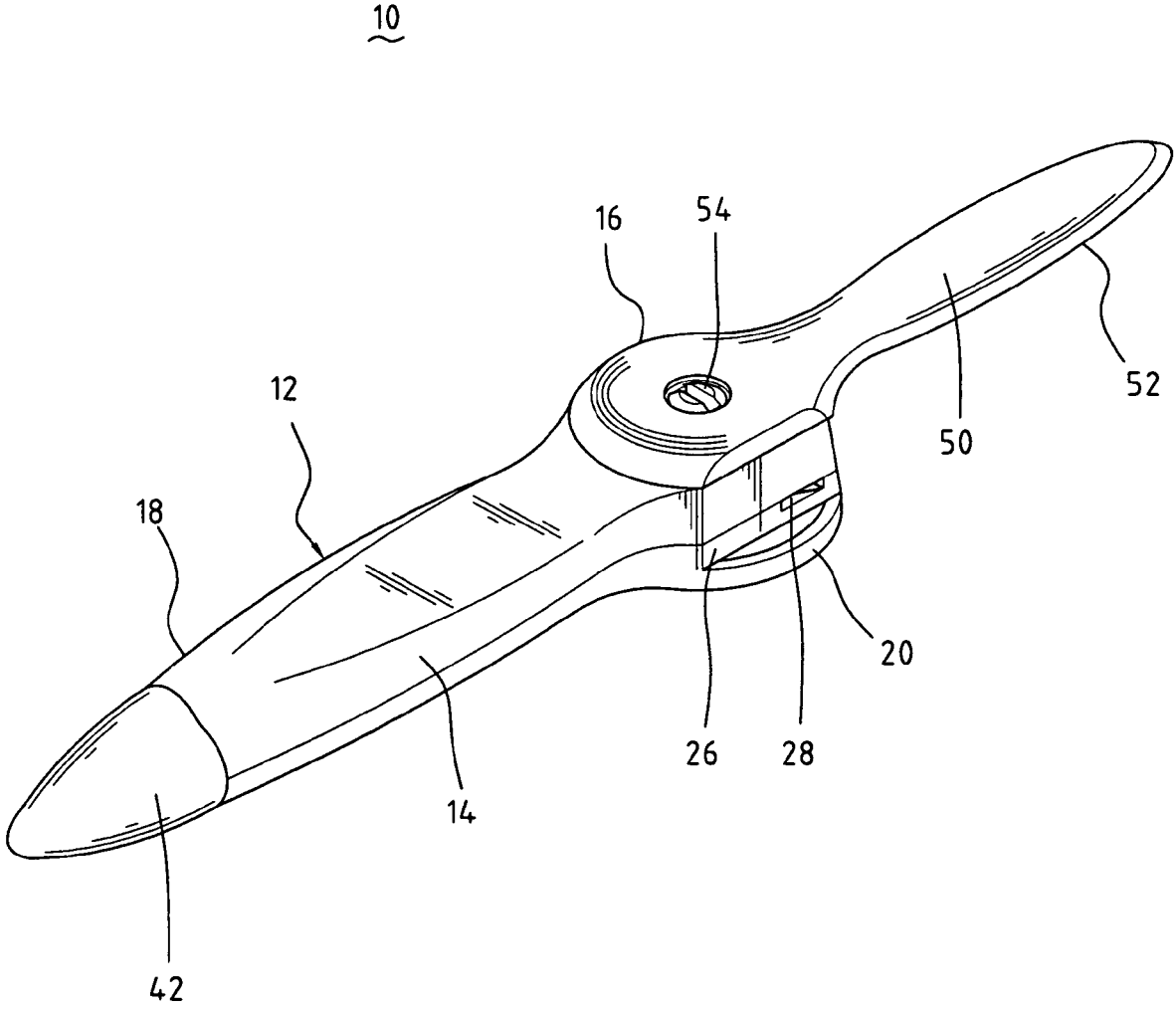
FIG. 3 is another perspective view of the optic disk pack opener, taken in a direction opposite to that of FIG. 2, with the writing implement capped but the optic disk surface cleaner extended, a sharp blade slot being visible.
Figure 4:
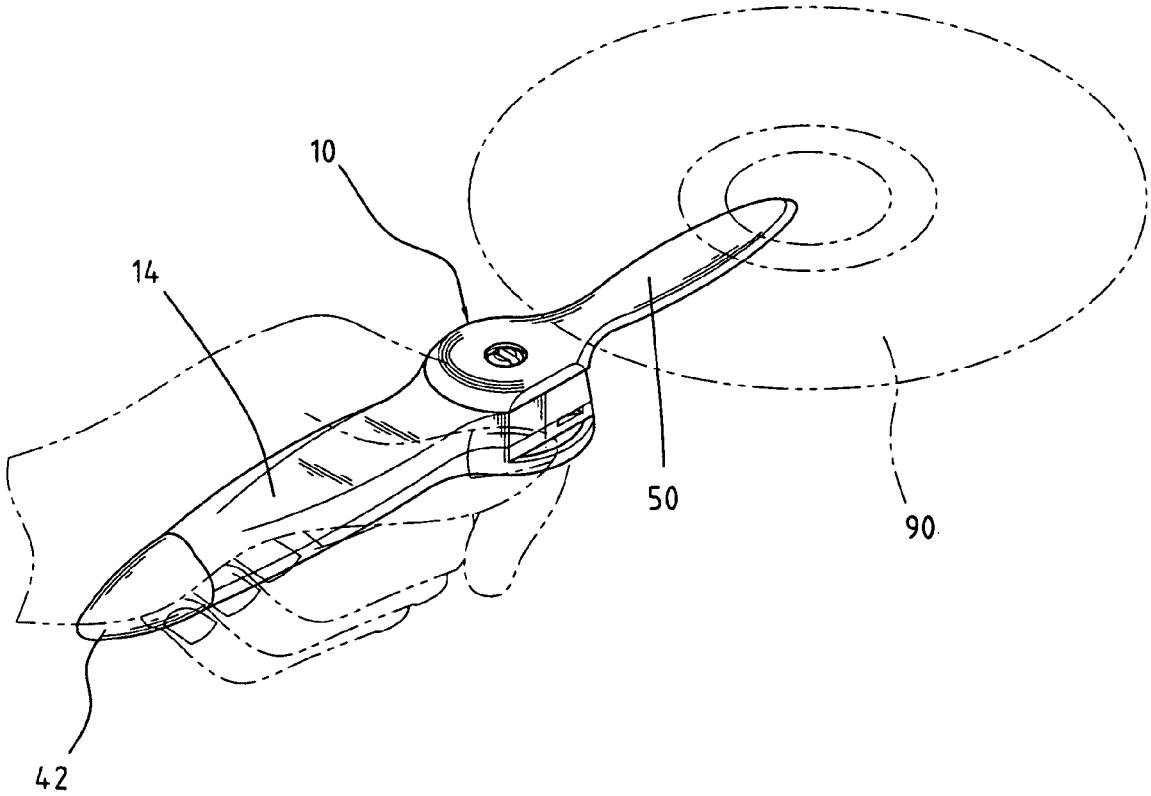
FIG. 4 is a perspective view similar to FIG. 3, with an optic disk to be cleaned by the optic disk surface cleaning member of the present invention shown in phantom lines to illustrate the operation of optic disk surface cleaning member of the present invention.

Also referring to FIGS. 3 and 4, an elongate member 50 having a flat surface 52 serving as an optic disk surface cleaning member is pivoted to the first end 16 of the stem 14 by a pivot pin 54 and has a length that substantially overlaps the stem 14 except the writing implement 40 and the cap 42. Preferably, the first end 16 is a circular expansion of the stem 14 and the pivot pin 52 coincides the center of the circular expansion. The flat surface 52 is provided with a layer 54 of soft material or fabric that is commonly used to wipe and clean the surface of an optic disk 90 (see FIG. 4). The pivotal joint between the optic disk surface cleaning member 50 and the stem 14 allows the optic disk surface cleaning member 50 to be movable between an operation position, as shown in FIGS. 2-4, where the optic disk surface cleaning member 50 is extended and the soft layer 54 exposed for cleaning the surface of the optic disk 90 as illustrated in FIG. 4, and a stowed position as illustrated in FIG. 1, where the optic disk cleaning member 50 overlaps the stem 14 with the soft layer 54 shielded by the stem 14.

Although the present invention has been described with reference to the preferred embodiment thereof, it is apparent to those skilled in the art that a variety of modifications and changes may be made, for example replacing the bowl with a fork, without departing from the scope of the present invention which is intended to be defined by the appended claims.

What is claimed is:

1. An opener comprising:

a body having a first end defining an interior space;

a slot defined in the first end of the body and delimited by two spaced flanges and a bottom between the flanges, the slot being adapted to receive a pack that is wrapped with a breakable wrapping film, whereby the slot is sized to allow for sliding movement of the opener with respect to an edge of the pack;

a breaking element received in the interior space and selectively extendible out of the interior space through an opening defined in the bottom of the slot to physically engage the pack for breaking the wrapping film when the opener is moved along the edge of the pack.

2. The opener as claimed in claim 1, wherein the breaking element comprising a sharp blade received in the interior space of the first end of the body.

3. The opener as claimed in claim 2 further comprising a biasing element applying a basing force to retain the sharp blade inside the interior space.

4. The opener as claimed in claim 3 further comprising a manual driving member that drives the sharp blade against the biasing force into the slot to physically engage the pack.

5. The opener as claimed in claim 4, wherein the biasing element comprising a leaf spring.

6. The opener as claimed in claim 5, wherein the leaf spring forms a projection extending outside the interior space through a further opening to be manually depressible and serving as the manual driving member.

7. The opener as claimed in claim 1, wherein the body comprises an elongate stem for hand holding.

8. The opener as claimed in claim 7, wherein the body has an opposite second end to which a writing implement is mounted.

9. The opener as claimed in claim 8, wherein the body comprises an elongate stem serving as a handholding barrel for the writing implement.

10. The opener as claimed in claim 1 further comprising an elongate member mounted to the body, the elongate member having a flat surface on which a soft layer is mounted to serve as a cleaning member for a surface of an optic disk.

11. The opener as claimed in claim 10, wherein the elongate member is pivoted to the first end of the body and movable between an operation position where the elongated member is extended to expose the soft layer and a stowed position where the elongate member overlaps the body with the soft layer shielded by the body.

12. An opener comprising:

a body having a first end defining an interior space;

a slot defined in the first end of the body and delimited by two spaced flanges and a bottom between the flanges, the slot being adapted to receive a pack that is wrapped with a breakable wrapping film, whereby the slot is sized to allow for sliding movement of the opener with respect to an edge of the pack;

a breaking element received in the interior space and selectively extendible out of the interior space through an opening defined in the bottom of the slot to physically engage the pack for breaking the wrapping film when the opener is moved along the edge of the pack; and an elongate cleaning member mounted to the body, the elongate member having a flat surface on which a soft layer is mounted, the soft layer being adapted to wipe and clean a surface of an optic disk.

13. The opener as claimed in claim 12, wherein the breaking element comprising a sharp blade received in the interior space of the first end of the body.

14. The opener as claimed in claim 13 further comprising a biasing element applying a basing force to retain the sharp blade inside the interior space.

15. The opener as claimed in claim 14 further comprising a manual driving member that drives the sharp blade against the biasing force into the slot to physically engage the pack.

16. The opener as claimed in claim 15, wherein the biasing element comprising a leaf spring.

17. The opener as claimed in claim 16, wherein the leaf spring forms a projection extending outside the interior space through a further opening to be manually depressible and serving as the manual driving member.

18. The opener as claimed in claim 12, wherein the body comprises an elongate stem for hand holding.

19. The opener as claimed in claim 12, wherein the elongate cleaning member is pivoted to the first end of the body and movable between an operation position where the elongated cleaning member is extended to expose the soft layer and a stowed position where the elongate cleaning member overlaps the body with the soft layer shielded by the body.

20. The opener as claimed in claim 12, wherein the body has an opposite second end to which a writing implement is mounted.

* * * * *